US006777023B2

(12) United States Patent
Rodenbaugh et al.

(10) Patent No.: US 6,777,023 B2
(45) Date of Patent: Aug. 17, 2004

(54) METHOD AND APPARATUS FOR MONITORING GRANULE COLORATION ON AN ASPHALT COATED SHEET

(75) Inventors: David R. Rodenbaugh, Baltimore, OH (US); John D. Phillips, Pataskala, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/345,526

(22) Filed: Jan. 16, 2003

(65) Prior Publication Data

US 2003/0108662 A1 Jun. 12, 2003

Related U.S. Application Data

(63) Continuation of application No. 09/796,005, filed on Feb. 28, 2001, now abandoned.

(51) Int. Cl.[7] ..... B05D 1/12
(52) U.S. Cl. ..... 427/8; 427/186; 427/188
(58) Field of Search ..... 427/8, 186–188; 118/668, 672, 676, 682, 687, 689–691, 308, 310

(56) References Cited

U.S. PATENT DOCUMENTS 5,283,080 A * 2/1994 Lamb et al.
5,664,385 A 9/1997 Koschitzky
6,174,403 B1 * 1/2001 Steiner, Jr. et al.

OTHER PUBLICATIONS

The Encyclopedia of Physics, 3rd Edition, pp. 193–199, 1990.* www.pfonline.com, "Assuring Paint Color at Behr" , Apr. 1994.*

PIMA Buyer's Guide, p. 2, From Internet Website.*

* cited by examiner

*Primary Examiner*—Fred J. Parker
(74) *Attorney, Agent, or Firm*—Inger H. Eckert; James J. Dottavio

(57) ABSTRACT

A method of producing asphalt strip shingles includes continuously coating a substrate with asphalt to form an asphalt coated sheet, moving the asphalt coated sheet in a machine direction, depositing blend drops of blend drop granules onto the asphalt coated sheet from a blender, providing a signal indicative of the presence of the blend drops at a location downstream from the blender, sensing the color of the blend drops at the downstream location with a sensor, comparing the sensed color of the blend drops with a reference color, and providing a signal indicative of the comparison.

32 Claims, 3 Drawing Sheets

METHOD AND APPARATUS FOR MONITORING GRANULE COLORATION ON AN ASPHALT COATED SHEET

This application is a continuation of application Ser. No. 09/796,005, filed Feb. 28, 2001, abandoned, the contents of which are incorporated herein by reference.

TECHNICAL FIELD

This invention relates to the manufacture of shingles, such as roofing shingles, and in particular, to shingles having granules of a background color and blend drops of granules of various shades of colors that are different from the background color. More particularly, this invention pertains to a method of monitoring the color of various portions of the shingle.

BACKGROUND OF THE INVENTION

Asphalt-based roofing materials, such as roofing shingles, roll roofing and commercial roofing, are installed on the roofs of buildings to provide protection from the elements, and to give the roof an aesthetically pleasing look. Typically, the roofing material is constructed of a substrate such as a glass fiber mat or an organic felt, an asphalt coating on the substrate, and a surface layer of granules embedded in the asphalt coating.

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective and decorative surface granules onto portions of the asphalt sheet material.

In the manufacture of colored shingles, two types of granules are typically employed. Headlap granules are granules of relatively low cost used for the portion of the shingle that will be covered up on the roof. Colored granules or prime granules are of relatively higher cost and are applied to the portion of the shingle that will be exposed on the roof.

To provide a color pattern of pleasing appearance, the colored portion of the shingles may be provided with areas of different colors. Usually the shingles have a background color and a series of granule deposits of different colors or different shades of the background color. A common method for manufacturing the shingles is to discharge blend drops onto spaced areas of the tacky, asphalt coated sheet. Background granules are then discharged onto the sheet and they adhere to the tacky, asphalt coated areas of the sheet between the granule deposits formed by the blend drops. The term "blend drop", as used herein, refers to the flow of granules of different colors or different shades of color (with respect to the background color) that is discharged from a granule blend drop applicator onto the asphalt coated sheet. The patch or assemblage of the blend drop granules on the asphalt coated sheet is also referred to as the "blend drop".

The apparatus for depositing granules onto the asphalt coated sheet is referred to as a blender, which can be comprised of a series of hoppers positioned to drop granules onto the sheet. In a typical blend drop shingle operation, the blender includes four hoppers that periodically deposit blend drops of granules of four different shades. The blender also includes a fifth hopper that drops background granules on the areas of the asphalt coated sheet that have not been covered by granules from the first four hoppers.

Various types of granule dispensing hoppers are known for use in granule blenders. One type of dispensing hopper is a fluted roll. Another type is a pneumatically assisted and controlled hopper as disclosed in U.S. Pat. No. 5,520,889 to Burton et al. Since the manufacture of shingles is carried out at high continuous line speeds of hundreds of feet per minute, coordination and timing for the granule deposits from the various hoppers is imperative. The blender is usually operated by an electronic blender controller that provides signals to the various granule hoppers to impart the proper sequencing and duration of the blend drops of each blend drop color, and of the background color.

The various shades or colors in each of the hoppers are typically created by mixing colored granules of different colors from several different supplies of granules, each of which is a pure or single color. For example, the first blend drop may be made by mixing three parts pure brown granules and one part pure black granules. The second blend drop may be made by mixing four parts pure brown granules and two parts pure white granules. Other combinations may be used for the third and fourth blend colors. The fifth hopper may contain background granules that are a color reflecting a combination of the granules from the first four hoppers.

One of the problems associated with the manufacture of shingles with blend drops is that the shade or color can deviate from the designed shade or color, and therefore be out of specification. This can occur because of incomplete mixing of the granules, or from a malfunction of the blender or the hopper for that particular blend drop. Deviations from the desired shade can also occur because of operator error associated with measuring and combining the granules for the blends from the original supplies of pure-colored granules. Sometimes defects or variations in shades or colors cannot be detected during the manufacturing of the shingles. In such cases the defect may not be discovered until the shingles are actually installed on a roof. It would be advantageous if there could be developed a method for monitoring the color of the various blend drops during the shingle manufacturing process.

SUMMARY OF THE INVENTION

The above objects as well as other objects not specifically enumerated are achieved by a method of producing asphalt strip shingles including depositing blend drops of blend drop granules onto an asphalt coated sheet, sensing the color of the blend drops; comparing the sensed color of the blend drops with a reference color, and providing a signal indicative of the comparison.

According to this invention, there is also provided a method of producing asphalt strip shingles including continuously coating a substrate with asphalt to form an asphalt coated sheet, moving the asphalt coated sheet in a machine direction, depositing blend drops of blend drop granules onto the asphalt coated sheet from a blender, providing a signal indicative of the presence of the blend drops at a location downstream from the blender, sensing the color of the blend drops at the downstream location with a sensor, comparing the sensed color of the blend drops with a reference color, and providing a signal indicative of the comparison.

According to this invention, there is also provided a method of producing asphalt strip shingles including making shingles of a first color on a shingle machine including programming a controller with a reference color, depositing blend drops of blend drop granules onto an asphalt coated sheet, sensing the color of the blend drops, comparing the sensed color of the blend drops with the reference color, and providing a signal indicative of the comparison. The shingle machine is switched to make shingles of another color. Then the shingle machine is switched back to again make shingles of the first color, using the programmed reference color for comparing the color of the blend drops.

Various objects and advantages of this invention will become apparent to those skilled in the art from the following detailed description of the preferred embodiment, when read in light of the accompanying drawings.

DETAILED DESCRIPTION OF THE INVENTION

Figure 1:
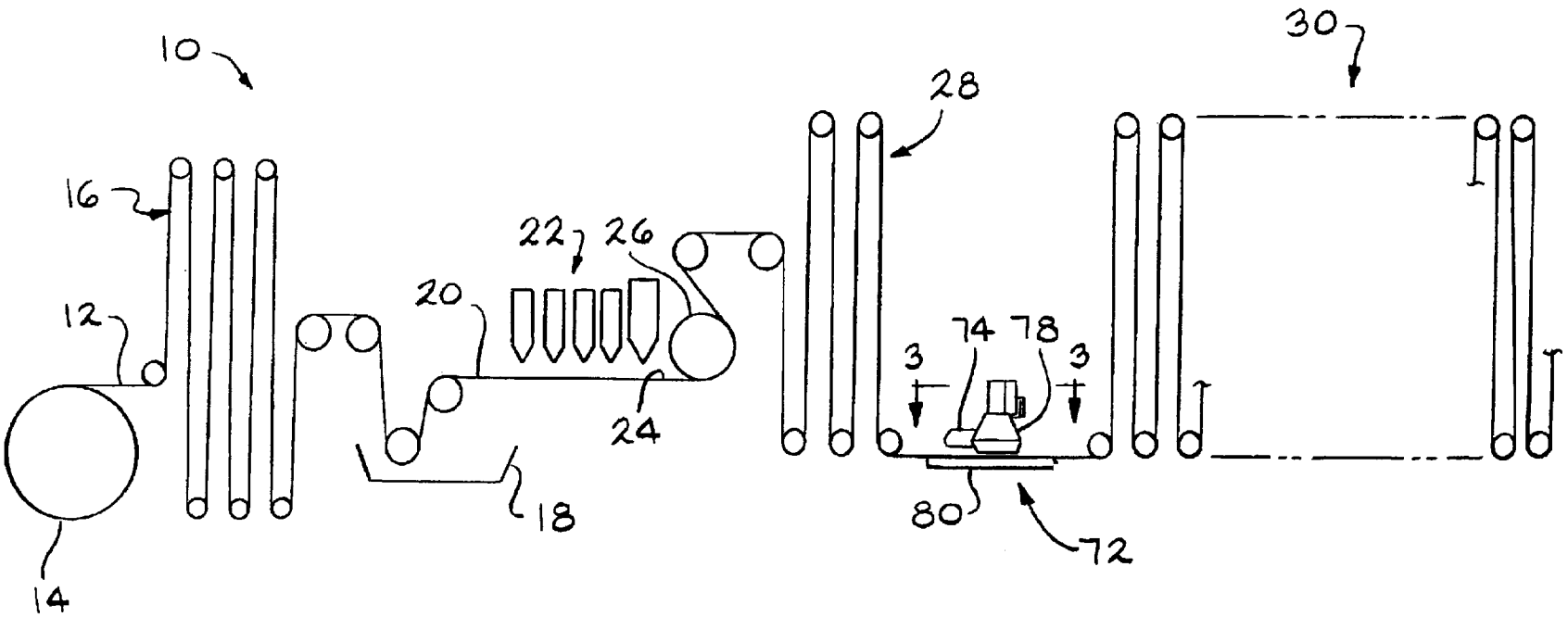
FIG. 1 is a schematic elevational view of an apparatus for making shingles according to the invention.
Figure 2:
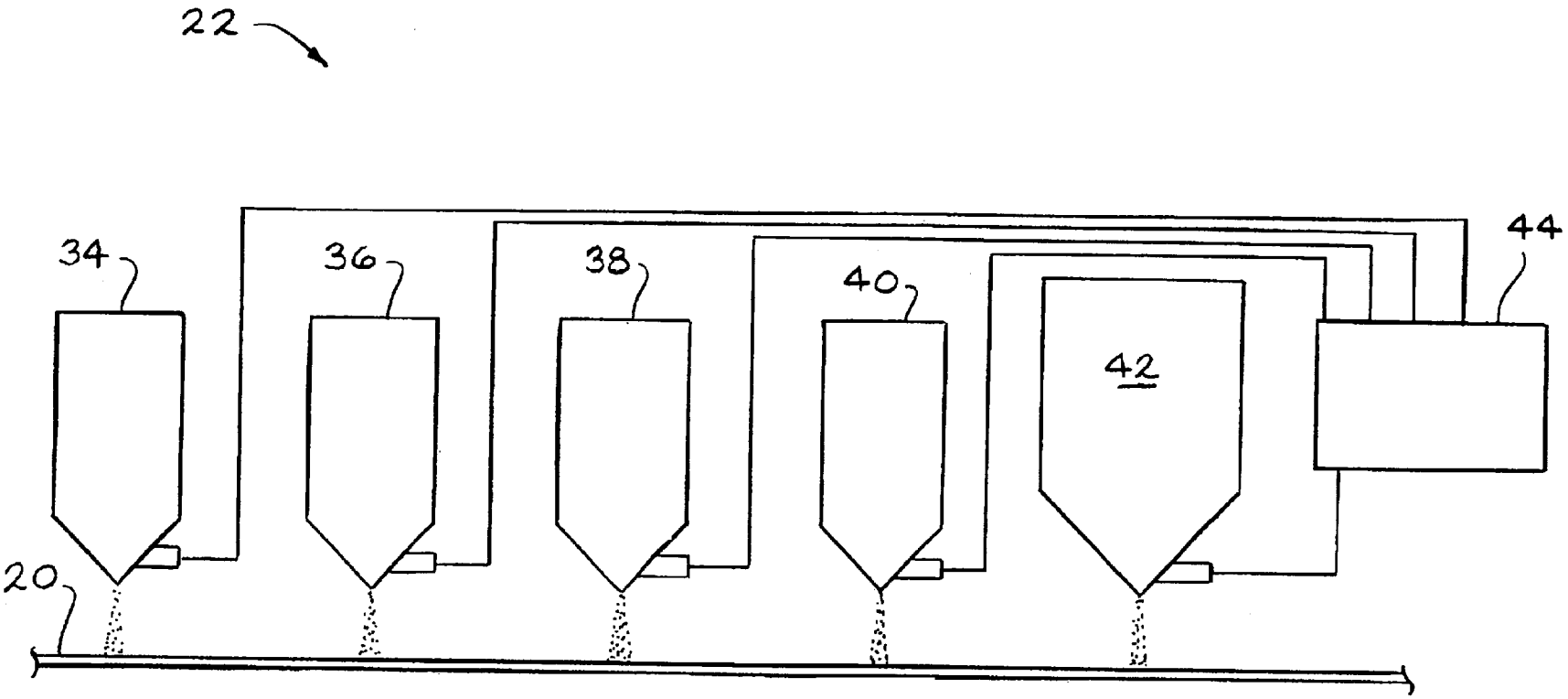
FIG. 2 is a schematic view in elevation of the blender portion of the apparatus of FIG. 1.

Referring now to the drawings, there is shown in FIGS. 1 and 2 an apparatus or shingle machine 10 for manufacturing an asphalt-based roofing material according to the invention. The illustrated manufacturing process involves passing a continuous sheet 12 of shingle mat in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the manufacturing process, a continuous sheet of substrate or shingle mat 12 is payed out from a roll 14. The substrate can be any type known for use in reinforcing asphalt-based roofing materials, such as a nonwoven web of glass fibers. The shingle mat can be temporarily stored on a mat accumulator 16 to handle variations in demand and supply. Shingle mat 12 from the accumulator is fed through a coater 18 where an asphalt coating is applied to the sheet. The asphalt coating can be applied in any suitable manner. In the illustrated embodiment, the sheet is submerged in a supply of hot, melted asphalt coating to completely cover the sheet with the tacky coating. However, in other embodiments, the asphalt coating could be sprayed on, rolled on, or applied to the sheet by other means. Typically the asphalt material is highly filled with a ground stone filler material, amounting to at least about 60 percent by weight of the asphalt/filler combination.

The resulting asphalt coated sheet 20 is then passed beneath the granule blender indicated generally at 22 for the application of granules to the upper surface of the asphalt coated sheet 20. The granule dispensers can be of any type suitable for depositing granules onto the asphalt coated sheet. A preferred granule dispenser is a granule blender of the type disclosed in U.S. Pat. No. 5,520,889 to Burton et al, which is hereby incorporated by reference, in its entirety. The granule blender is shown in more detail in FIG. 2, and its operation will be discussed below.

After all the granules are deposited on the asphalt coated sheet 20 by the blender 22, it becomes a granule covered sheet 24. The granule coated sheet 24 is turned around a slate drum 26 to press the granules into the asphalt coating and to temporarily invert the sheet so that the excess granules will fall off. These unattached granules are collected and reused. The granule covered sheet 24 is subsequently fed through a cooling section 28 where the temperature of the granule coated sheet 24 is reduced to give the sheet the desired handleability characteristics for cutting and packaging shingles. After the granule coated sheet 24 moves through the cooling section 28, the sheet is fed into the looper 30 where the granule coated sheet is temporarily stored until the sheet is delivered to the shingle cutter and packaging apparatus, both not shown. The cutter cuts the granule coated sheet 24 into lanes and cuts each lane into individual shingles. The cutter may also cut the shingles into designs having cutouts and tabs, depending on the desired design for the shingle.

As shown in FIG. 2, the granule blender 22 includes four blend drop hoppers 34, 36, 38, and 40. The final hopper is the background hopper 42. Each of the hoppers is supplied with granules from sources of granules, not shown. After the blend drops are deposited on the asphalt coated sheet 20, the remaining, uncovered areas are still tacky with warm, uncovered asphalt, and the background granules from hopper 42 will adhere to these areas that are not already covered with blend drop granules. Typically, the granules applied by the background hopper 42 are made up by collecting the backfall granules falling from the slate drum 26.

The hoppers 34, 36, 38, 40 and 42 can be of any type suitable for being employed to accurately deposit a blend drop of granules on the sheet. A preferred type of hopper is a pneumatically assisted and controlled hopper as disclosed in U.S. Pat. No. 5,520,889 to Burton et al. Each of the hoppers 34, 36, 38, and 40 deposits a blend drop of a different color or shade onto the asphalt coated sheet 20. Although blend drops can be of any size, a typical length for a blend drop is about 14 inches. At typical web speeds of hundreds of feet per minute, the flow of granules from any one of the hoppers 34, 36, 38 and 40 must be turned on and off in a very short time, i.e., a matter of a few seconds. Therefore, the hoppers must be provided with highly effective on and off gates. Also, in order to achieve the designed look or appearance of the shingles when assembled on a roof, the timing of the four blend drops from the four blend drop hoppers 34, 36, 38 and 40 must be precise. For that purpose, a blender controller 44 is connected to each of the hoppers 34, 36, 38 and 40. The blender controller provides a signal to each of the hoppers to initiate the blend drops and to conclude the blend drops. The blender controller can be any electronic controller suitable for providing the proper sequence and duration of the blend drops of each blend drop color, and of the background color.

As is well known in the art, blend drops applied to the asphalt coated sheet are often made up of granules of several different colors. For example, one particular blend drop that is supposed to simulate a weathered wood appearance might actually consist of some brown granules, some dark gray granules and some light gray granules. When these granules are mixed together and applied to the sheet in a generally uniformly mixed manner, the overall appearance of weathered wood is achieved. For this reason, the blend drops are referred to as having a color blend, which gives an overall color appearance, and this overall appearance may be different from any of the actual colors of the granules in the color blend. Also, blend drops of darker and lighter shades of the same color, such as, for example, dark gray and light gray, are referred to as different color blends rather than merely different shades of one color.

Figure 3:
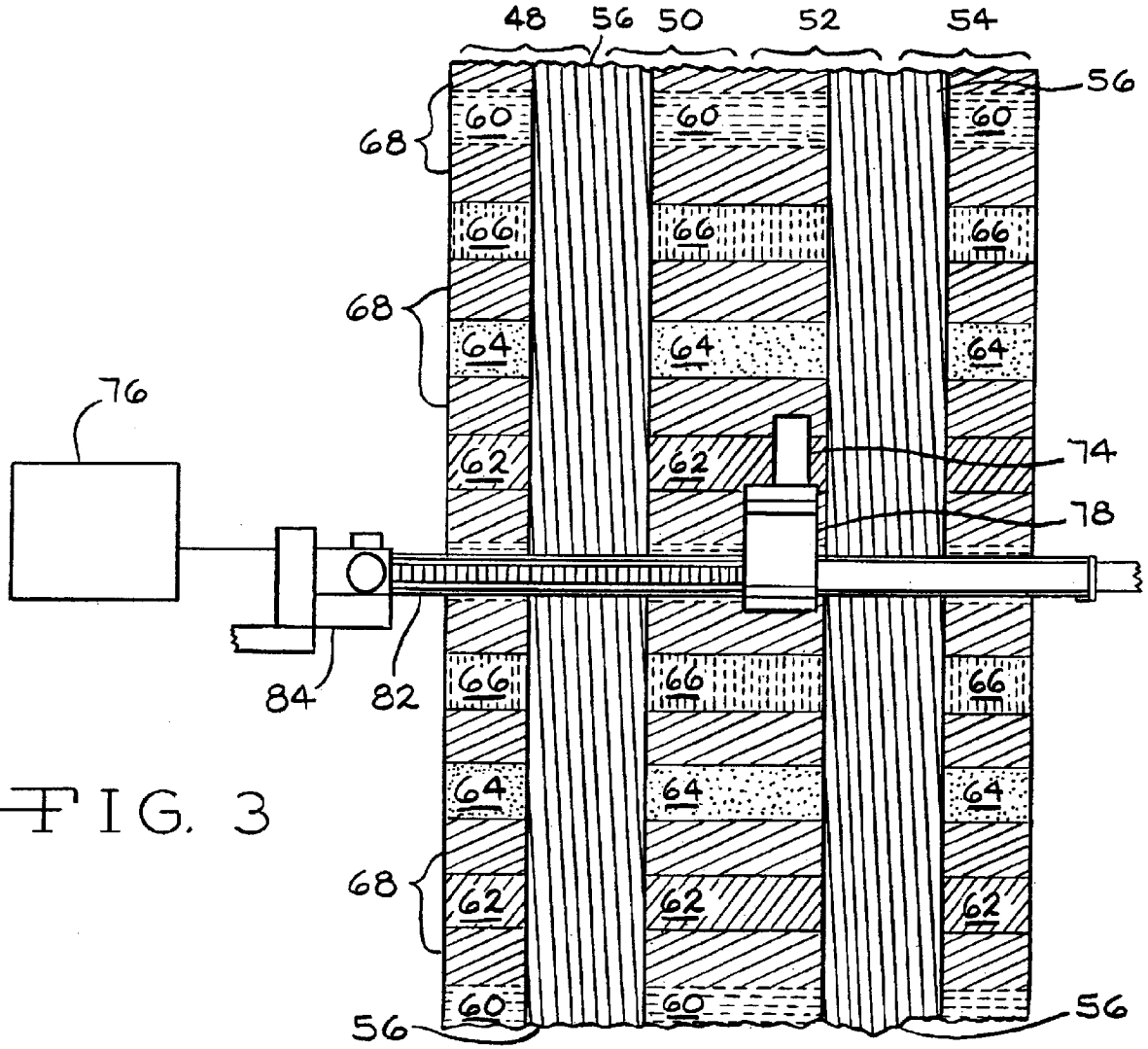
FIG. 3 is a schematic view in elevation, taken along line 3—3 of FIG. 1, of the granule coated asphalt sheet and the apparatus of the invention for monitoring the color of the various blend drops on the sheet.

Conventional shingle making machines use a wide shingle mat and continuously make three or four lanes of shingles at once. As shown in FIG. 3, the four lanes are indicated at 48, 50, 52 and 56, respectively. Headlap granules are applied by the background hopper 42 to the headlap areas, indicated at 56, that are positioned between adjacent shingle lanes. The blend drops from the first blend drop hopper are indicated at 60 on the granule coated sheet 24. The blend drops from the second, third and fourth hoppers are indicated at 62, 64 and 66, respectively. The background areas are indicated at 68.

As further shown in FIG. 3, at a downstream location 72 a sensor 74 is provided to view the blend drops for purposes of determining their color. Preferably, the sensor is an optical sensor. More particularly, the sensor 74 measures the visible spectrum reflected from the blend drops 60, 62, 64 and 66 and sends a signal to a color controller 76, the signal being indicative of the color detected by the sensor. A light source 78 is provided with the sensor 74. Preferably, the light source 78 is a strobe light mounted with the sensor and capable of rapid on and off flashing of light. Each flash of the strobe light source 74 generates a selected image for the sensor 74, and thereby originates a signal back to the color controller 76. Preferably, the sensor 74 is a spectrophotometer, which, as is well known to one skilled in the art, is a device structured and configured for sensing and measuring color in terms of the energy or intensity of reflected light at various, or a plurality of, wavelengths across the visible spectrum of light. Equipment that can be used for sensing the color of the blend drops is available commercially from Fife Corporation, Oklahoma City, Okla., under the trade name InSpectra™. A system using this equipment can include a display monitor and an operator interface operator.

The color controller 76 can be programmed with ranges of color acceptability for each of the blend drops. The controller includes a comparator that compares the sensed color of a blend drop with the predetermined range of color for that blend drop. If the sensed color is within the predetermined range, the color is acceptable. The color controller 76 can be programmed to generate various responses if the sensed color is outside the predetermined range. For example, an alarm could be sounded. Other responses could include changing the speed of the asphalt coated sheet and changing or adjusting the color of the granules in the blend.

An optional feature of the invention is a stabilizer plate 80 positioned beneath the granule coated sheet 24 for helping assure that the sheet is stable and not vibrating.

In view of the fact that there are four different colors of blend drops as well as the background color granules that will be viewed by the sensor 74, it is important to be sure that the sensor is accurately aligned with the blend drops 60, 62, 64 and 66. Preferably the sensor 74 is aligned with or focused on the center of each blend drop being viewed at the time that the strobe flashes. To provide information for the sensing operation (the strobe 78 and sensor 74) a signal is sent from the blend drop controller 44 to the strobe light source 78 via the color controller. A timing device, such as a clock or a pulse generating tachometer, not shown, is used to provide an accurate timing sequence to provide the appropriate signal to the strobe 78 to indicate the presence at the downstream location of the blend drop to be measured. There is a time lag between the time the blend drop is added to the asphalt coated sheet 20 and the time the sensor 74 is to view the blend drop. During operation of the shingle machine this time lag will vary with the speed of the sheet 24.

In order to be able to view all the blend drops of a four-wide shingle making machine of the type illustrated in the drawings, the sensor 74 and strobe 78 are mounted on a movable track 82. A motor 84 or any other suitable device is connected to a carriage, not shown, on which the sensor and strobe are mounted to move the sensor and strobe across all four lanes 48, 50, 52 and 54 of the sheet 24. It can be seen that the granule coated sheet 24 is moved in a machine direction, and the sensor 74 is moved across the granule coated sheet in a cross-machine direction to sense the color of the blend drops 60, 62, 64 and 66. It is to be understood that the sensing can be accomplished when the sheet is moving vertically as well as in the horizontal orientation shown in FIG. 3.

In one embodiment of the invention, the color of the blend drops from one of the hoppers is sensed for a period of time, including the blend drops of that color across the entire width of the granule coated sheet, as viewed by the sensor as it traverses in the cross-machine direction. Then, the color measuring equipment is switched to a mode where sensing the blend drops from another of the hoppers occurs. Whenever such a switchover occurs, a short delay in the resumption of sensing the color of the new bled drops can be observed. This suppression of the trigger signal to the strobe 78 will enable the granule coated sheet passing the blender to reach the downstream location before the color measuring process resumes on the new blend drops.

One particularly advantageous use of the method of the invention is in the production of asphalt shingles that are designed to simulate slate tiles. In such a case, each tab of the shingles is provided any one of several colors according to the color scheme. It is important that each blend drop be completely true to its designed color.

Another advantageous use of the method of the invention is that when shingle machines are switched from a first color to another color, and then returned to the first color, the sensor can assure that the color of the blend drops is within the desired specification upon restarting the shingle machine in production of the first color. For example, when switching from brown shingles to black shingles and back to brown shingles, the sensor can assure that all the blend drop colors associated with the brown shingles are within specification. The color controller can maintain the color specifications for each blend drop in its memory.

Although the invention has been described as having four blend drop hoppers 34, 36, 38 and 40 for applying four different blend drops 60, 62, 64 and 66, it is to be understood that any number of different blend drops can be used with the invention.

The principle and mode of operation of this invention have been described in its preferred embodiments. However, it should be noted that this invention may be practiced otherwise than as specifically illustrated and described without departing from its scope.

What is claimed is:

1. A method of producing asphalt strip shingles comprising:

depositing blend drops of blend drop granules onto an asphalt coated sheet, each of the blend drops having a color blend which gives the blend drop an overall color appearance;

providing an optical sensor structured and configured for sensing the intensity of reflected light at a plurality of wavelengths across the visible spectrum of light;

sensing the color of the deposited blend drops with the optical sensor;

comparing the sensed color of the deposited blend drops with a reference color;

and providing a signal indicative of the comparison.

2. The method of claim 1 in which the depositing step includes depositing blend drops from a plurality of hoppers, the blend drops from each hopper being of a different color from the blend drops from the other hoppers, and further including applying background granules to the asphalt coated sheet after applying the blend drops to form a granule coated sheet.

3. The method of claim 2 including moving the granule coated sheet in a machine direction and moving the sensor across the granule coated sheet in a cross-machine direction to sense the color of the blend drops.

4. The method of claim 2 including sensing the color of the blend drops from one of the hoppers for a period of time, and then switching to sensing the color of blend drops from another of the hoppers.

5. The method of claim 1 including adjusting the color of the granules from the hopper in response to the sensed color of the blend drop.

6. The method of claim 1 including adjusting the speed of the asphalt coated sheet in response to the sensed color of the blend drop.

7. The method of claim 1 in which the sensing involves viewing an area of the blend drop that is less than the total area of the blend drop.

8. The method of claim 1 in which the depositing step includes depositing blend drops from a plurality of hoppers, the blend drops from each hopper being of a different color from the blend drops from the other hoppers, and further including applying background granules to the asphalt coated sheet after applying the blend drops to form a granule coated sheet, and further including moving the granule coated sheet in a machine direction and moving the sensor across the granule coated sheet in a cross-machine direction to sense the color of the deposited blend drops, and further including sensing the color of the deposited blend drops from one of the hoppers for a period of time, and then switching to sensing the color of blend drops from another of the hoppers.

9. A method of producing asphalt strip shingles comprising:

continuously coating a substrate with asphalt to form an asphalt coated sheet;

moving the asphalt coated sheet in a machine direction;

depositing blend drops of blend drop granules onto the asphalt coated sheet from a hopper, each of the blend drops having a color blend which gives the blend drop an overall color appearance;

providing a signal indicative of the presence of the deposited blend drops at a location downstream from the hopper;

providing an optical sensor structured and configured for sensing the intensity of reflected light at a plurality of wavelengths across the visible spectrum of light;

sensing the color the deposited blend drops at the downstream location with the optical sensor;

comparing the sensed color of the deposited blend drops with a reference color; and, providing a signal indicative of the comparison.

10. The method of claim 9 including using a timing device to provide the signal indicative of the presence of the blend drops at the downstream location.

11. The method of claim 9 including using a light source to reflect an image for the optical sensor us part of the step of sensing the color of the deposited blend drops.

12. The method of claim 9 in which the depositing step includes depositing blend drops from a plurality of hoppers, the blend drops from each hopper being or a different color from the blend drops from the other hoppers, and further including applying background granules to the asphalt coated sheet after applying the blend drops to form a granule coated sheet.

13. The method of claim 12 including moving the granule coated sheet in a machine direction and moving the sensor across the granule coated sheet in a cross-machine direction to sense the color of the deposited blend drops.

14. The method of claim 12 including sensing the color of the blend drops from one of the hoppers for a period of time, and then switching to sensing the color of deposited blend drops from another of the hoppers.

15. The method of claim 9 including using a timing device to provide the signal indicative of the presence of the blend drops at the downstream location, using a light source to reflect an image for the optical sensor as part of the step of sensing the color of the deposited blend drops, and wherein the depositing step includes depositing blend drops from a plurality of hoppers, the blend drops from each hopper being of a different color from the blend drops from the other hoppers, and further including applying background granules to the asphalt coated sheet after applying the blend drops to form a granule coated sheet.

16. The method of claim 15 including moving the granule coated sheet in a machine direction and moving the sensor across the granule coated sheet in a cross-machine direction to sense the color of the deposited blend drops.

17. The method of claim 15 including sensing the color of the blend drops from one of the hoppers for a period of time, and then switching to sensing the color of blend drops from another of the hoppers.

18. A method of producing asphalt strip shingles comprising:

making shingles of a first color on a shingle machine including programming a controller with a reference color, depositing blend drops of blend drop granules on an asphalt coated sheet, each of the blend drops having a color blend which gives the blend drop an overall color appearance, sensing the color of the deposited blend drops with an optical sensor structured and configured for sensing the intensity of reflected light as a plurality of wavelengths across the visible spectrum of light, comparing the sensed color of the deposited blend drops with reference color, and providing a signal indicative of the comparison;

switching the shingle machine to make shingles of another color; and switching back the shingle machine to again make shingles of the first color, using the programmed reference color for comparing the color of the blend drops;

wherein when the sensed color of the deposited blend drop is outside a predetermined range of color, a first signal is provided, and when the sensed color of the deposited blend drop is inside a predetermined range of color, a second signal is provided.

19. A method of producing asphalt strip shingles comprising:

continuously coating a substrate with asphalt to form an asphalt coated sheet;

moving the asphalt coated sheet in a machine direction;

depositing blend drops of blend drop granules onto the asphalt coated sheet from a hopper;

providing a signal indicative of the presence of the blend drops at a location downstream from the hopper;

providing an optical sensor;

sensing a color of the deposited blend drops at the downstream location with the optical sensor, while using a timing device to provide the signal indicative of the presence of the blend drops at the downstream location; and comparing the sensed color of the deposited blend drops with a reference color; and providing a signal indicative of the comparison.

20. The method of claim 19 including using a light source to reflect an image for the optical sensor as part of the step of sensing the color of the deposited blend drops.

21. The method of claim 19 in which the depositing step includes depositing blend drops from a plurality of hoppers, the blend drops from each hopper being of a different color from the blend drops from the other hoppers, and further including applying background granules to the asphalt coated sheet after applying the blend drops to form a granule coated sheet.

22. The method of claim 21 including moving the granule coated sheet in a machine direction and moving the sensor across the granule coated sheet in a cross-machine direction to sense the color of the deposited blend drops.

23. The method of claim 21 including sensing the color of the blend drops from one of the hoppers for a period of time, and then switching to sensing the color of blend drops from another of the hoppers.

24. The method of claim 19 including using a timing device to provide the signal indicative of the presence of the blend drops at the downstream location, using a light source to reflect an image for the optical sensor as part of the step of sensing the color of the blend drops, and wherein the depositing step includes depositing blend drops from a plurality of hoppers, the blend drops from each hopper being of a different color from the blend drops from the other hoppers, and further including applying background granules to the asphalt coated sheet after applying the blend drops to form a granule coated sheet.

25. The method of claim 24 including moving the granule coated sheet in a machine direction and moving the sensor across the granule coated sheet in a cross-machine direction to sense the color of the deposited blend drops.

26. The method of claim 24 including sensing the color of the deposited blend drops from one of the hoppers for a period of time, and then switching to sensing the color of deposited blend drops from another of the hoppers.

27. A method of producing asphalt strip shingles comprising:

continuously coating a substrate with asphalt to form an asphalt coated sheet;

moving the asphalt coated sheet in a machine direction;

depositing blend drops of blend drop granules onto the asphalt coated sheet from a plurality of hoppers;

using a timing device to provide a signal indicative of the presence of the deposited blend drops at a location downstream from the hopper;

providing an optical sensor;

sensing a color of the deposited blend drops at the downstream location with the optical sensor, using a light source to reflect an image for the optical sensor;

comparing the sensed color of the deposited blend drops with a reference color; and providing a signal indicative of the comparison;

wherein the blend drops from each hopper are of a different color from the blend drops from the other hoppers, and further including applying background granules to the asphalt coated sheet after applying the blend drops to form a granule coated sheet.

28. The method of claim 27 including using a light source to reflect an image for the optical sensor as part of the step of sensing the color of the deposited blend drops.

29. The method of claim 27 including moving the granule coated sheet in a machine direction and moving the sensor across the granule coated sheet in a cross-machine direction to sense the color of the blend drops.

30. The method of claim 27 including sensing the color of the blend drops from one of the hoppers for a period of time, and then switching to sensing the color of deposited blend drops from another of the hoppers.

31. The method of claim 30 including moving the granule coated sheet in a machine direction and moving the sensor across the granule coated sheet in a cross-machine direction to sense the color of the deposited blend drops.

32. The method of claim 30 including sensing the color of the blend drops from one of the hoppers for a period of time, and then switching to sensing the color of blend drops from another of the hoppers.

* * * * *